United States Patent [19]

Neyraud

[11] 4,161,969

[45] Jul. 24, 1979

[54] METHOD TO CONNECT TWO STRING-LIKE MEMBERS

[75] Inventor: René Neyraud, Saint Cyr au Mont d'Or, France

[73] Assignee: Verdol, SA., Caluire, France

[21] Appl. No.: 896,529

[22] Filed: Apr. 14, 1978

[30] Foreign Application Priority Data

Apr. 18, 1977 [FR] France ..... 77 12475

[51] Int. Cl.[2] ..... D03C 3/44; B25G 3/36

[52] U.S. Cl. ..... 139/90; 24/115 R; 24/129 R; 403/393

[58] Field of Search ..... 139/89, 90; 403/393; 24/115 R, 129 R

[56] References Cited

U.S. PATENT DOCUMENTS 407,708 7/1889 Weaver ..... 403/393

2,808,043 10/1957 Lombard ..... 24/129 R 2,861,311 11/1958 Kurland ..... 24/115 R

FOREIGN PATENT DOCUMENTS 991,051 5/1965 United Kingdom ..... 139/90

*Primary Examiner*—Henry Jaudon

*Attorney, Agent, or Firm*—Dowell and Dowell

[57] ABSTRACT

A connection between two string-like members, as for instance a heddle and the rubber cord which biasses it downwardly, is effected by first stretching the end portion 2*a* of the rubber cord 2, applying the stretched end portion longitudinally along the corresponding end portion of the heddle 1, preferably between the two wires 1*a*, 1*b* of which the heddle 1 is made, binding both end portions by an appropriate adhesive 7 and closely winding on the whole a covering sheet 5, such as an aluminium foil.

9 Claims, 5 Drawing Figures

METHOD TO CONNECT TWO STRING-LIKE MEMBERS

This invention relates to the mutual connection or junction of two string-like flexible members one of which is resilient and is adapted to exert a returning force on the other. Such a connection may be found in looms equipped with jacquards, wherein each heddle has its lower end attached to a rubber cord, the latter being in turn attached by its other end to a hook carried by a lower cross member of the loom frame.

In such looms the heddles are raised by the jacquard and they should be thereafter returned to their lower position. In former looms this was obtained by lingos or by spiral springs. But rubber cords are now preferably used for this purpose.

A problem with such rubber cords is however that they wear rapidly where they are in rubbing contact with metallic parts, which means that they have to be changed from time to time. A solution to this problem has been proposed in U.S. Pat. No. 3,537,487 (Servillat). It has worked satisfactorily but the junction thus realized is somewhat cumbersome which of course reduces the possible number of heddles for a given horizontal area.

An object of the present invention is to provide a connection or junction which will have a reduced cross-sectional area.

In accordance with the invention the end portions of the elements to be connected with each other are disposed side by side, the end portion of the resilient element is extended to such a degree that its diameter is more contracted than it may be in the remainder of this element during the operation of the device to which both elements are associated, the adjacent end portions are bound to each other by means of any appropriate means and a thin covering is closely wound on the assembly.

In the accompanying drawings:

FIG. 1 is a perspective view of the ends of the elements to be connected with each other.

FIG. 2 diagrammatically illustrates in perspective a device for carrying into practice the method according to the invention.

Figure 1:
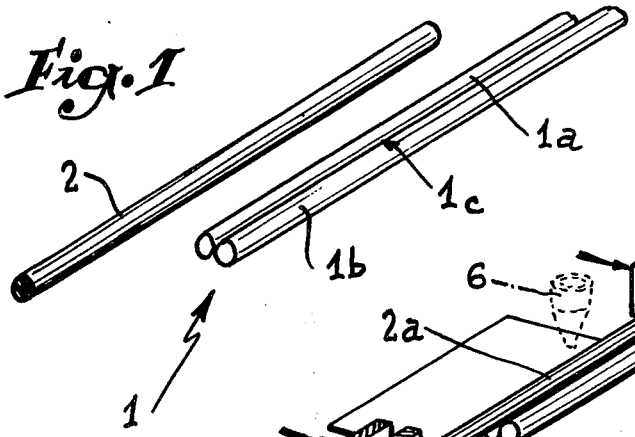

Referring to FIG. 1 reference numeral 1 designates the lower end of a heddle for use in a loom equipped with a jacquard, while 2 is the upper end of a rubber cord adapted to act as a spring to return the heddle downwardly after it has been raised by the jacquard. It will be noted that in the conventional manner the heddle 1 is formed of two steel wires 1*a*, 1*b* soldered to each other. Of course the lower end of the rubber cord 2 is to be attached to a cross-member of the loom frame and this is effected by means of a hook having a straight tail or rod which may be assimilated, for the purpose of its connection with the rubber cord, to the lower end of the heddle.

Figure 2:
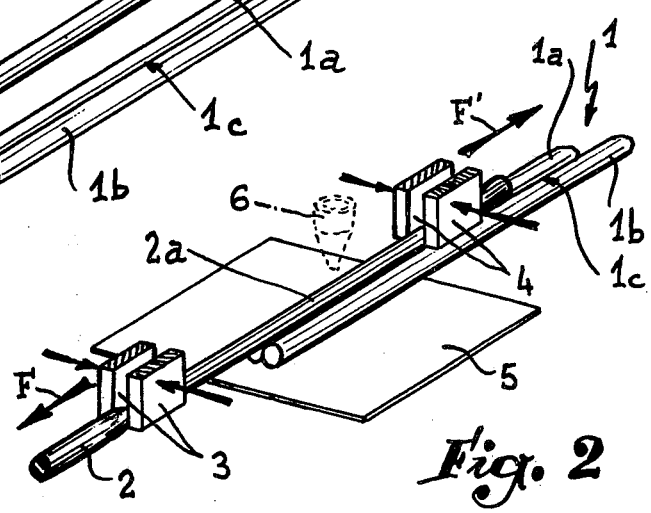

The ends of the portion 2*a* of the rubber cord 2 which is to be connected with the heddle 1 are caught between the jaws of two spaced clamping devices 3 and 4 (FIG. 2) and these devices are moved apart (arrows F and F') to tension and stretch cord 2. Consequently the diameter of the stretched portion 2*a* decreases as its length increases. The stretching operation is continued until the said diameter is lower than the smallest diameter which the cord may take during normal operation of the loom. In other words the tension imparted to portion 2*a* is higher than the highermost tension to which the remainder of cord 2 may be submitted in the loom. Portion 2*a* is then applied longitudinally on the lower end of heddle 1 disposed substantially horizontally for this purpose, preferably in the longitudinal depression 1*c* formed between the two wires 1*a*, 1*b* which constitute the said end (see FIG. 1). A covering sheet 5, preferably an aluminium foil, is disposed below the heddle end in contact with the latter. A nozzle 6 provided above portion 2*a* then permits of pouring dropwise a quick-setting adhesive, such as for instance a cyanoacrylate compound. The covering sheet 5 is thereafter tightly wrapped around the superposed ends 2*a*, 1*a*, 1*b* (see FIG. 4) in order that the adhesive may set under pressure and without any inclusion of air bubbles.

Figure 3:
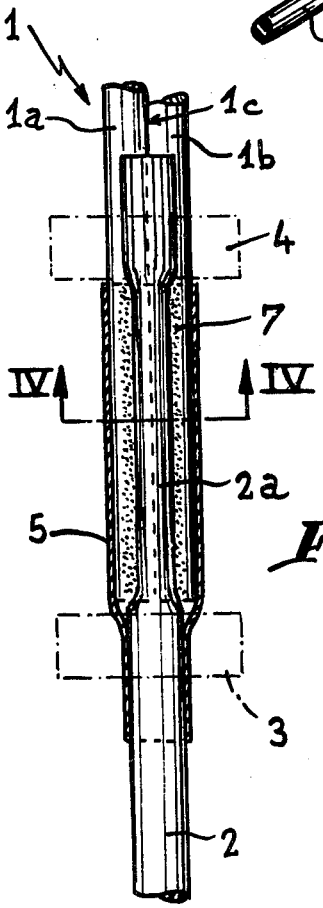
FIG. 3 is an enlarged side view of the junction, the outer covering sheet being shown in section.

FIG. 3 illustrates to an enlarged scale the junction finally obtained. The adhesive layer has been referenced 7. When it is sufficiently set, the jaws 3 and 4 may be opened to liberate the rubber cord 2, the end portion 2*a* of which is firmly retained by the adhesive within the covering 5 without any possible increase of its diameter.

Figure 4:
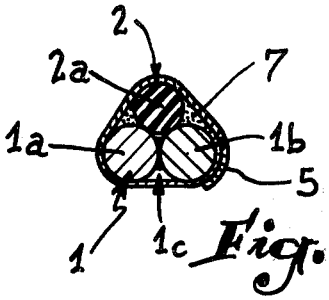
FIG. 4 is a cross section taken along line IV—IV of FIG. 3.
Figure 5:
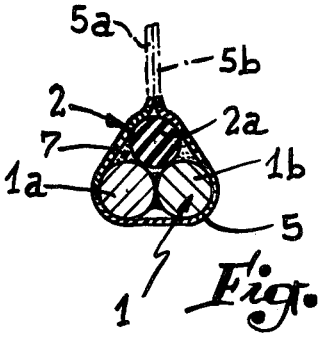
FIG. 5 is a cross-section similar to that of FIG. 4, but corresponding to a modification.

The covering sheet may be wound on wires 1*a*, 1*b* and on portion 2*a* as illustrated in FIG. 4, that is by superposing its end edges. But it is also possible to join the ends of the sheet in a vertical plane above portion 2*a*, as shown in FIG. 5. When the adhesive has set, the projecting end portions are cut close to portion 2*a*.

As shown in FIGS. 4 and 5, the horizontal cross-section of the junction finally realized is of quite reduced area, in contradistinction to the junctions of the prior art which generally included a hook or at least a loop at the lower end of the heddle.

It is obvious that the same kind of connection or junction may be used between the lower end of the rubber cord and the tail of a hook or the like adapted to be fixed to the lower cross member of the loom.

It is further to be understood that the term "adhesive" used in the foregoing description includes any substance which may set to retain the adjacent ends of the rubber cord and of the heddle or hook, as for instance a thermo-setting or thermoplastic material applied in the form of a varnish or by injection. Also the outer covering could be formed of a layer of a synthetic material injected under pressure within a suitable mold.

What I claim is:

1. The method of connecting to a string-like member an elastically extensible member to provide a return-spring action when the extensible member is stretched within a predetermined stretch limit, the extensible member being of a type which reduces in diameter when stretched, including the steps of:

stretching a portion of said extensible member to reduce its diameter;

disposing the stretched portion adjacent to a connecting portion of the string-like member;

applying to said adjacent stretched and connecting portions of the members a settable substance to bond them together;

disposing a covering material about said stretched and connecting portions to tightly confine said settable substance;

setting said substance while confined;

and releasing said stretched portion of said extensible member when said substance has been set.

2. The method as claimed in claim 1, wherein the stretched portion of said extensible member is stretched beyond said predetermined limit while said settable substance is being confined and set, so that its diameter during setting of the substance is smaller than the smallest diameter which it reaches while being stretched within said predetermined limit.

3. The method as claimed in claim 1, wherein an adhesive is applied as said substance.

4. The method as claimed in claim 1, wherein a cyanoacrylate is applied as said substance.

5. The method as claimed in claim 1, wherein said covering material is sheet material wound around said portions with the free end of the sheet material superimposed on the covering.

6. The method as claimed in claim 1, wherein said covering material is sheet material wound around said portions with the ends of the sheet material brought together at right angles to the covering.

7. The method as claimed in claim 1, wherein the covering material is aluminum foil wound around said portions.

8. The method as claimed in claim 1, wherein said covering material is a layer of plastic material molded about said portions.

9. A joint between a string-like member and an elastically extensible member to provide a return-spring action when the extensible member is stretched within a predetermined stretch limit, the extensible member being of a type which reduces in diameter when stretched, comprising:

a connecting portion of said string-like member;

a stretched portion of said extensible member, the extensible member in said portion being stretched beyond said predetermined limit and the stretched portion being disposed adjacent to said connecting portion;

an adhesive substance bonding together said stretched and connecting portions; and a covering sheet surrounding and tightly confining said adhesive substance and said stretched and connecting portions, the diameter of the stretched portion being smaller than the smallest diameter which it reaches while being stretched within said predetermined limit.

* * * * *